US005431577A

United States Patent [19]

Lincoln

[11] Patent Number: 5,431,577

[45] Date of Patent: Jul. 11, 1995

[54] FLOATING ESCUTCHEON

[75] Inventor: Thomas C. Lincoln, Arcadia, Calif.

[73] Assignee: Uni-Star Industries, Inc., South Pasadena, Calif.

[21] Appl. No.: 271,515

[22] Filed: Jul. 7, 1994

[51] Int. Cl.[6] ..... H01R 13/629

[52] U.S. Cl. ..... 439/248

[58] Field of Search ..... 439/248, 247, 374, 376, 439/252

[56] References Cited

U.S. PATENT DOCUMENTS 4,960,387 10/1990 Davis et al. ..... 439/374

5,329,262 7/1994 Fisher, Jr. ..... 439/247

*Primary Examiner*—Gary F. Paumen

*Attorney, Agent, or Firm*—Lyman R. Lyon

[57] ABSTRACT

A floating escutcheon prevents contact damage during mating and unmating of pin and socket connectors and comprises a hollow member slidably supported relative to one of the connectors and having a central aperture for the acceptance of the other connector in telescoping relationship only when the angle between a central axes of the pins and sockets is less than a predetermined angle.

2 Claims, 2 Drawing Sheets

FLOATING ESCUTCHEON

BACKGROUND OF THE INVENTION

This invention relates generally to connectors and more specifically to a floating escutcheon that facilitates mating of the plug and receptacle of a connector pair.

The free standing contacts of a connector are generally protected by a shroud. The contacts of the connector are generally recessed from the shroud to improve protection. However, the contacts of pin and socket connectors are occasionally damaged during mating or unmating of the connector pair by "scooping," or by "hinging." "Scooping" occurs when the shroud of one connector strikes the free standing contacts of the other connector. "Hinging" occurs when one end of a long-narrow connector is improperly mated and/or unmated.

SUMMARY OF INVENTION

The aforesaid problem relating to mating and unmating of connectors is solved, in accordance with a preferred constructed embodiment of the present invention, by a unique floating escutcheon that effects orientation and control of the connectors as they move into assembled relation with one another thereby to prevent contact damage. The floating escutcheon effects mechanical control of the critical mating and unmating angle of penetration or withdrawal as opposed to relying upon operator technique. The floating escutcheon of the invention averts potential connector contact damage due to "scooping" by; (a) minimizing the angle of penetration between two mating connectors; (b) increasing the effective shrouded length of the connectors; and (c) by reducing the clearance heretofore required between the telescoped shrouds. The floating escutcheon also prevents premature release ("hinging") of the far side shroud when unmating long narrow connectors.

In the preferred embodiment, the floating escutcheon is provided with two flanges having channels which accept a pair of jackposts. Annular recesses on the jackposts cooperate with the channels on the escutcheon so as to allow the escutcheon to "float" relative to a mounting surface. Because the escutcheon "floats," as it controls the approach angle of the mating connector, it-does not interfere with normal connector interface surfaces associated with mating and unmating control of the connectors.

More specifically, the present invention provides for improved mating and unmating of microminiature twist pin style connectors similar to the MIL-C-83513 configuration. Such pin connectors are panel mounted from the rear of the panel by jackscrews which extend through complementary apertures in the panel for threaded engagement with the pin. The jackposts have a threaded bore for the acceptance of screws that retain the connector on the panel and an undercut or annular recess on the jackpost O.D. that accommodates and captures the floating escutcheon. Dimensions are controlled to minimize axial movement while allowing ample radial range or "float."

The removable socket connector has a contact shroud with internal dimensions slightly larger than the shroud on the pin connector and external dimensions slightly smaller than the opening in the floating escutcheon. After entering the floating escutcheon, the socket connector shroud collides with the pin connector shroud. However, because the escutcheon floats, centering of the mating interfaces is unimpeded. By the time the pin connector has penetrated the socket connector to the point where the socket contacts reside, the angle between the central axes of pins and sockets is within predetermined control limits set by clearance and the escutcheon guide length. The angle of the central axes ($\theta$) is a tangent function of clearances (C) and guide length (LG). For small angles, it may be defined as:

$$\theta = \tan^{-1}\frac{C}{LG}$$

In practice, a change in clearance of 0.002" changes the penetration or entry angle 1°. Normally, the maximum allowable central axes angle to avert contact damage is 5°.

Unintentional scooping of contacts is prevented because the pin connector is recessed into the floating escutcheon. Until the angular conditions for proper mate have been met, the pin connector is excluded from the zone of the socket connector contacts. Thus, the floating escutcheon offers a scoop proofing feature.

Hinging or "jackknifing" of a connector occurs when one end of a long narrow connector pair is improperly mated or unmated. The worst contact damage occurs after the far end of the connector is clear. With the floating escutcheon, the opportunity for the far end of the connector to "jackknife" is diminished. Again, the centerline at angle of penetration or withdrawal is within control limits set by clearance and the guide length provided by the floating escutcheon.

The floating escutcheon can be adapted to nearly any connector configuration including square and circular. The escutcheon is most useful where the freestanding contacts are near the front of the protective shroud and are therefore most likely to be damaged as a result of low mating height requirements.

DETAILED DESCRIPTION OF THE PREFERRED EMBODIMENT

Figure 5:
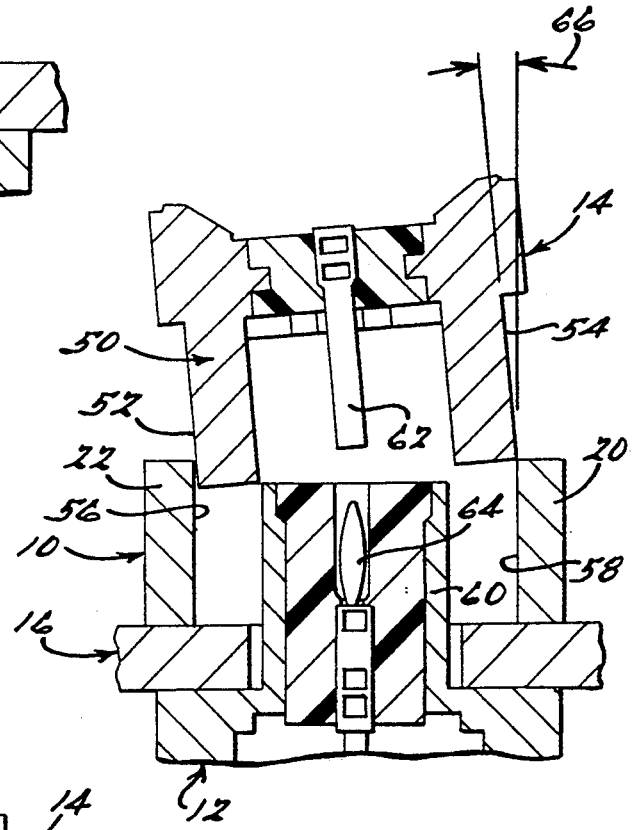
FIG. 5 is a view similar to FIG. 4, but showing the floating escutcheon of the present invention in control of the mating angle between pin and socket connectors.
Figure 6:
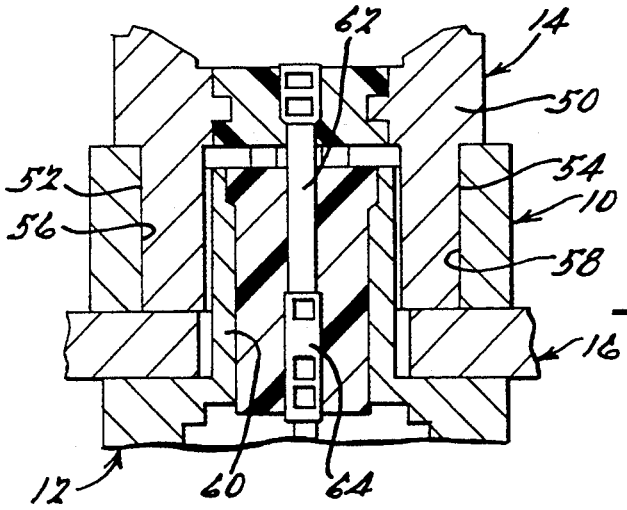
FIG. 6 is a side view of the assembled pin and socket connectors of FIG. 5.

As best seen in FIGS. 5 and 6, a floating escutcheon 10 is shown in operative associated with a pin connector or receptacle 12 and a socket connector or plug 14. In the disclosed embodiment, the pin connector 12 is secured to a mounting panel 16. The escutcheon 10 of the present invention has particular application to the mating and unmating of, for example, a 51-pin microminiature twist pin style connector pair, reference military specification MIL-C-83513.

Figure 1:
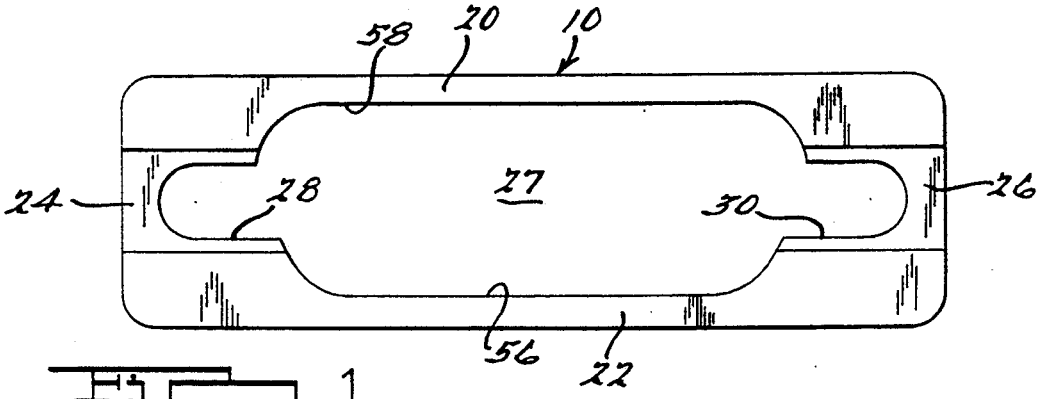
FIG. 1 is a plan view of a floating escutcheon in accordance with the instant invention.
Figure 2:
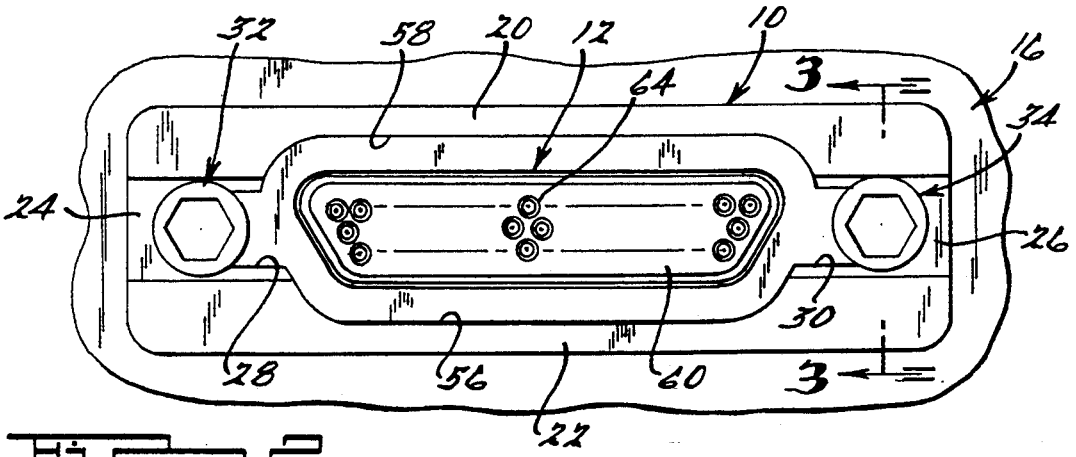
FIG. 2 is a view similar to FIG. 1 of the floating escutcheon guide assembled about a panel mounted pin connector and secured to the panel by jackscrews.

As seen in FIGS. 1 and 2, the floating escutcheon 10 is of generally rectangular configuration defined by parallel walls 20 and 22 that are joined together by end walls 24 and 26 thereby to define a central opening 27. The end walls 24 and 26 are provided with channels 28 and 30, respectively, for the acceptance of a pair of jackposts 32 and 34, respectively.

Figure 3:
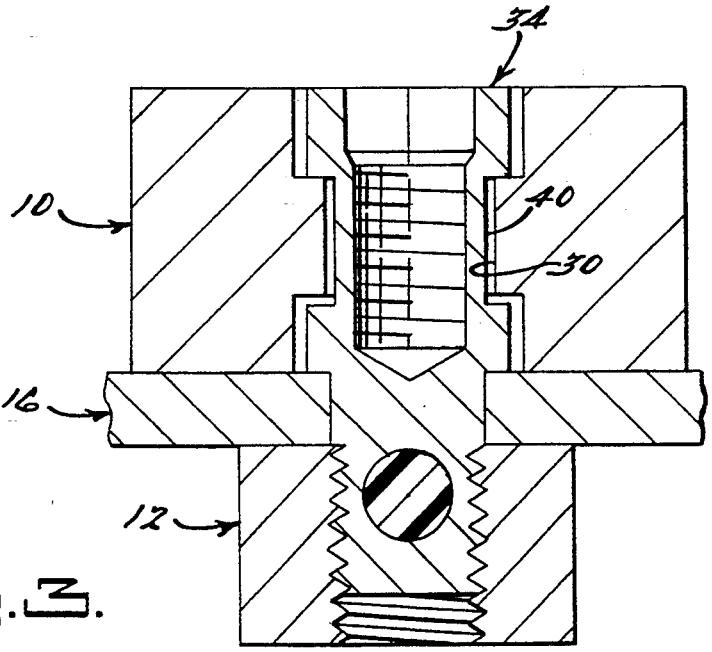
FIG. 3 is a cross-sectional view taken along line 3—3 of FIG. 2.
Figure 4:
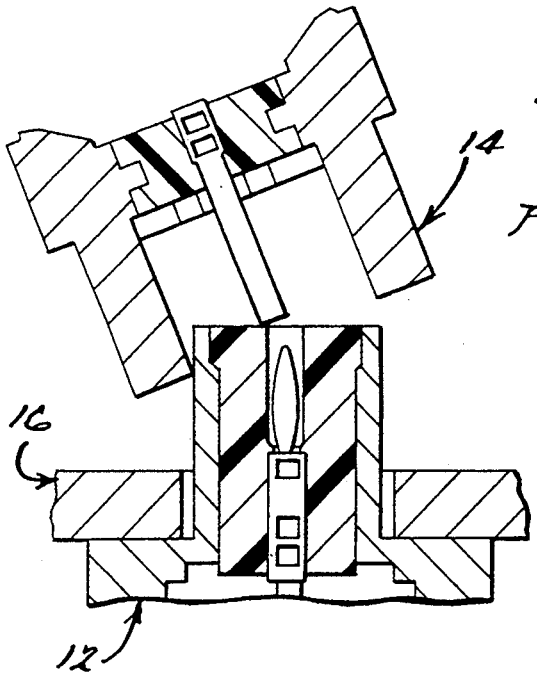
FIG. 4. Prior Art
FIG. 4 is a cross-sectional view of a prior art connector pair showing possible misalignment during mating.

As best seen in FIGS. 3, 5 and 6, the pin connector 12 is mounted to the panel 16 from the rear by the jackposts 32 and 34. The jackposts 32 and 34 are provided with annular recesses, respectively, one of which is illustrated and designated by the numeral 40, which are accepted in the channels 28 and 30 of the floating escutcheon guide 10. As best seen in FIG. 3, the jackpost channel 40 is of smaller diameter than the width of the channel 30 in the floating escutcheon 10 thereby to permit limited lateral movement or "float" of the escutcheon 10 along the surface of the panel 16 relative to the jackposts 32 and 34.

In operation, and as best seen in FIG. 6, a shroud 50 on the socket connector 14 has external surfaces 52 and 54 that are spaced apart slightly less than the spacing of the internal surfaces 56 and 58 of the side walls 20 and 22, respectively, of the floating escutcheon 10, so as to be accepted therebetween. After entering the floating escutcheon guide 10, the shroud 50 of the socket connector 14 is guided into alignment with a shroud 60 on the pin connector 12. Because the escutcheon 10 "floats," centering of the mating socket and pin connector occurs unimpeded by the normal interface surfaces of shrouds 50 and 60. By the time the pin connector 12 has penetrated to the point where the contacts 52 of the socket connector 14 engage the pin contacts 64 of the pin connector 12, the angle of the central longitudinal axes of the sockets 52 relative to that of the pins 64 is within a predetermined control angle designated by the numeral 66.

Unintentional scooping of contacts is prevented because the pin contacts 64 are recessed relative to the floating escutcheon 10. Stated in another manner, until the conditions for proper mating have been met, the pins 64 of the pin connector 12 are excluded from the interference zone of the socket contacts 62. Thus, the floating escutcheon 10 provides a scoop proofing feature.

From the foregoing is should be apparent that the floating escutcheon 10 of the present invention limits the mating angle of between two mateable connectors of a connector pair thereby averting contact damage which may otherwise occur when mating or unmating.

While the preferred embodiment of the invention has been disclosed, it should be appreciated that the invention is susceptible of modification without departing from the scope of the following claims.

I claim:

1. In an electrical connector system comprising:

a socket connector and a pin connector mateable with said socket connector and wherein, one of said connectors has a shroud thereabout that accepts the other of said connectors in telescoping relationship, the improvement comprising:

a floating escutcheon for preventing contact damage during mating and unmating of said pin and socket connectors comprising a hollow member slidably supported in a lateral direction relative to the other of said connectors and having a central aperture for the acceptance of the shroud of said one connector in telescoping relationship only when the angle between a central axes of said pins and sockets is less than a predetermined angle.

2. The system of claim 1, wherein said escutcheon is supported for slidable movement relative to said other connector by a set of jackposts having circumferential channels which interlock with complementary channels in said escutcheon.

* * * * *